US009126442B1

(12) United States Patent
Takabatake et al.

(10) Patent No.: US 9,126,442 B1
(45) Date of Patent: Sep. 8, 2015

(54) PRINTER

(71) Applicant: FUJITSU COMPONENT LIMITED, Tokyo (JP)

(72) Inventors: Yoshinari Takabatake, Tokyo (JP); Sumio Watanabe, Tokyo (JP); Yukihiro Mori, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 14/628,395

(22) Filed: Feb. 23, 2015

(30) Foreign Application Priority Data

Feb. 28, 2014 (JP) ..... 2014-039623

(51) Int. Cl.
*B41J 11/66* (2006.01)
*B41J 11/70* (2006.01)
*B41J 29/02* (2006.01)

(52) U.S. Cl.
CPC .. *B41J 11/70* (2013.01); *B41J 29/02* (2013.01)

(58) Field of Classification Search
USPC ..... 400/621; 347/101, 104, 222
See application file for complete search history.

(56) References Cited

U.S. PATENT DOCUMENTS

| | | | | |
|---|---|---|---|---|
| 7,059,793 | B2 * | 6/2006 | Mori et al. | 400/621 |
| 7,267,500 | B2 * | 9/2007 | Tsuchiya et al. | 400/621 |
| 7,273,325 | B2 * | 9/2007 | Watanabe et al. | 400/621 |
| 7,857,534 | B2 * | 12/2010 | Watanabe et al. | 400/621 |
| 8,411,119 | B2 * | 4/2013 | Tsuchiya et al. | 347/157 |
| 2009/0148217 | A1 * | 6/2009 | Sanada et al. | 400/120.16 |
| 2010/0232092 | A1 | 9/2010 | Sakamoto | |
| 2011/0026999 | A1 * | 2/2011 | Kohira | 400/621 |
| 2012/0272805 | A1 * | 11/2012 | Kondo et al. | 83/102 |
| 2014/0186087 | A1 * | 7/2014 | Aizawa | 400/621 |

FOREIGN PATENT DOCUMENTS

| | | |
|---|---|---|
| JP | 2010-173129 | 8/2010 |
| JP | 2010-214658 | 9/2010 |

* cited by examiner

*Primary Examiner* — Huan Tran
(74) *Attorney, Agent, or Firm* — IPUSA, PLLC

(57) ABSTRACT

A printer includes a printer body, a lid, a damper spring, and a slidable part. The lid is connected to the printer body so as to be opened and closed relative to the printer body. The damper spring is provided on the printer body and includes a coil spring and first and second ends extending from first and second ends of the coil spring, respectively, and engaging with each other. The damper spring exerts a restoring force in a direction to move the first and second ends of the damper spring away from each other. The slidable part is provided in the printer body. When the lid is opened, the slidable part is pressed by the lid so as to press the first end of the damper spring so that the damper spring exerts the restoring force in a direction to close the lid.

9 Claims, 23 Drawing Sheets

PRINTER

CROSS-REFERENCE TO RELATED APPLICATION

The present application is based upon and claims the benefit of priority of Japanese Patent Application No. 2014-039623, filed on Feb. 28, 2014, the entire contents of which are incorporated herein by reference.

BACKGROUND OF THE INVENTION

1. Field of the Invention

The present invention relates to printers.

2. Description of the Related Art

Printers that output receipts are widely used for shop registers and automated teller machines (ATMs) or cash dispensers (CDs) in banks. In such printers that output receipts, printing is performed on thermal paper that serves as recording paper or sheets with a thermal head while conveying the recording paper, and after conveying the recording paper a predetermined length, the recording paper is cut by a cutter to the predetermined length. Such a cutter includes a fixed blade and a movable blade, and the movable blade moves toward the fixed blade so as to cut the recording paper held between the fixed blade and the movable blade.

Such printers include clamshell printers. Clamshell printers include a printer body and a lid that is connected to the printer body in such a manner as to be openable and closable relative to the printer body. By closing the lid after loading a roll of recording paper into the printer body, printing is ready to be performed on the recording paper. Clamshell printers as well include a cutter for cutting the recording paper. Because the recording paper is held and cut between the fixed blade and the movable blade of the cutter, one of the fixed blade and the movable blade is provided in the printer body and the other is provided on the lid. Therefore, according to clamshell printers, by closing the lid, the fixed blade and the movable blade are placed at predetermined positions where the fixed blade and the movable blade function as a cutter, so that the recording paper is ready to be cut with the fixed blade and the movable blade.

Reference may be made to Japanese Laid-Open Patent Applications No. 2010-173129 and No. 2010-214658.

SUMMARY OF THE INVENTION

According to an aspect of the present invention, a printer includes a printer body, a lid, a damper spring, and a slidable part. The lid is connected to the printer body so as to be opened and closed relative to the printer body. The damper spring is provided on the printer body and includes a coil spring and first and second ends extending from first and second ends of the coil spring, respectively, and engaging with each other. The damper spring exerts a restoring force in a direction to move the first and second ends of the damper spring away from each other. The slidable part is provided in the printer body. When the lid is opened, the slidable part is pressed by the lid so as to press the first end of the damper spring so that the damper spring exerts the restoring force in a direction to close the lid.

According to an aspect of the present invention, a printer includes a printer body, a metal cover, a lid, a cutter, a fixed blade unit, and a movable blade unit. The printer body includes a print head. The metal cover is attached to the printer body so as to cover the printer body except for one side of the printer body. The lid is connected to the printer body or the metal cover so as to be opened and closed relative to the one side of the printer body. The cutter includes a fixed blade and a movable blade that cuts recording paper. The fixed blade unit is provided in the printer body and includes the fixed blade. The movable blade unit is provided on the lid and includes the movable blade.

DESCRIPTION OF THE EMBODIMENTS

Figure 1:
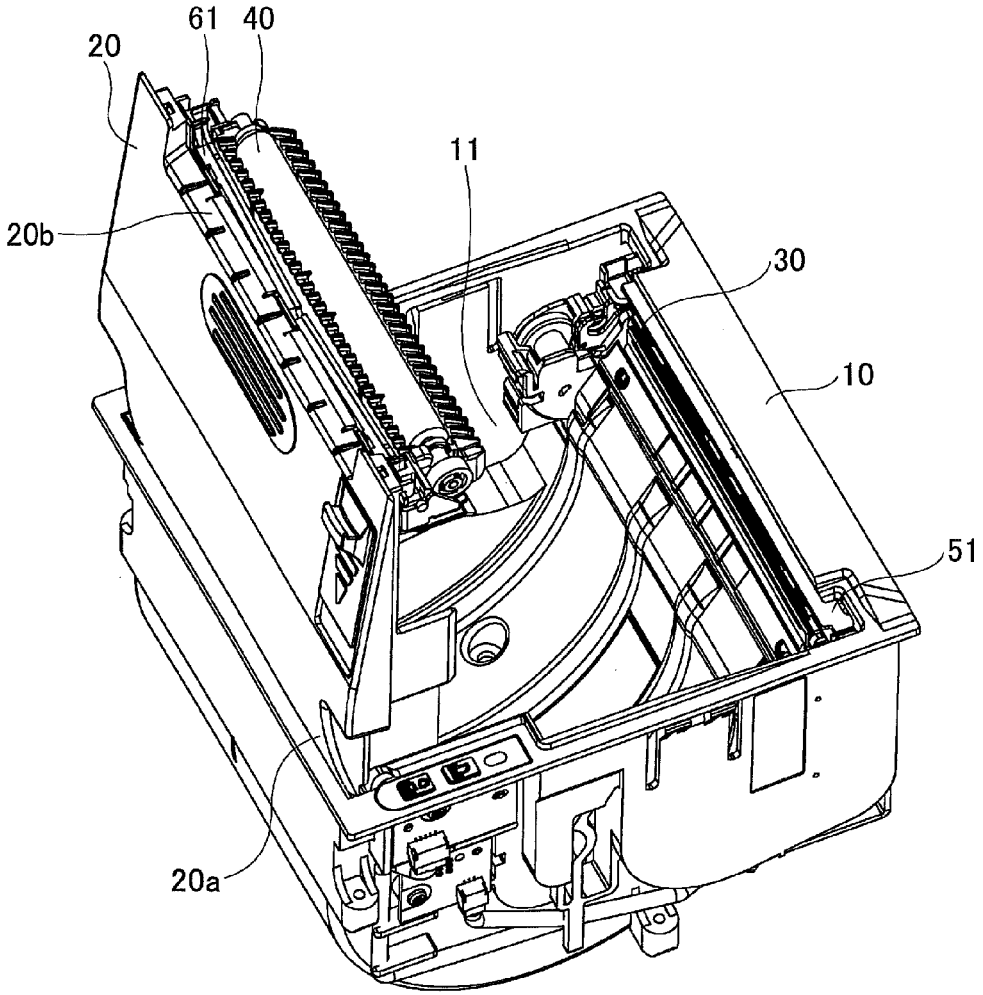
FIG. 1 is a perspective view of a printer with a lid opened according to an embodiment.

One or more embodiments of the present invention are described below with reference to the accompanying drawings. The same elements are referred to by the same reference numeral, and are not further described.

A printer according to an embodiment is described with reference to FIGS. 1 through 4.

Figure 2:
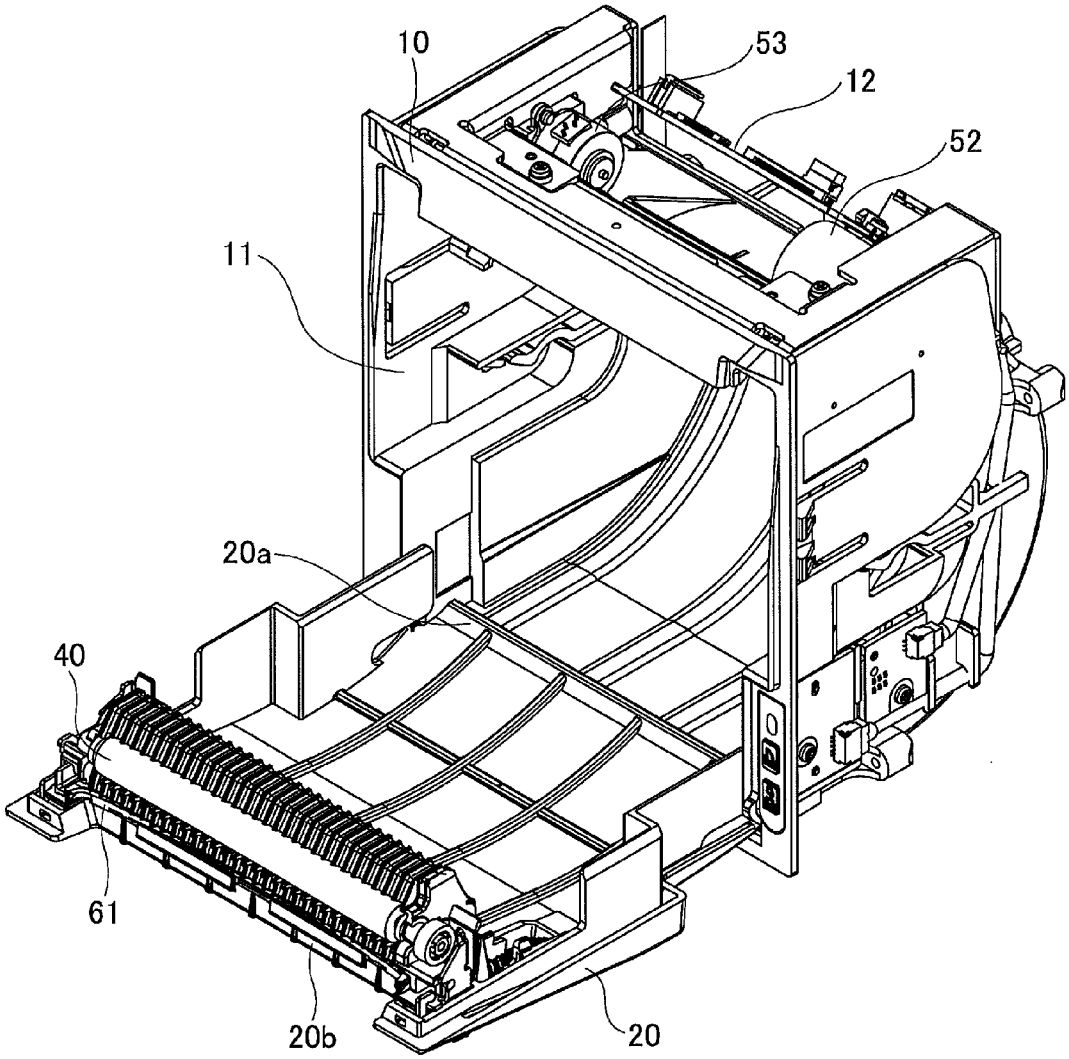
FIG. 2 is a perspective view of the printer with the lid opened according to the embodiment.
Figure 3:
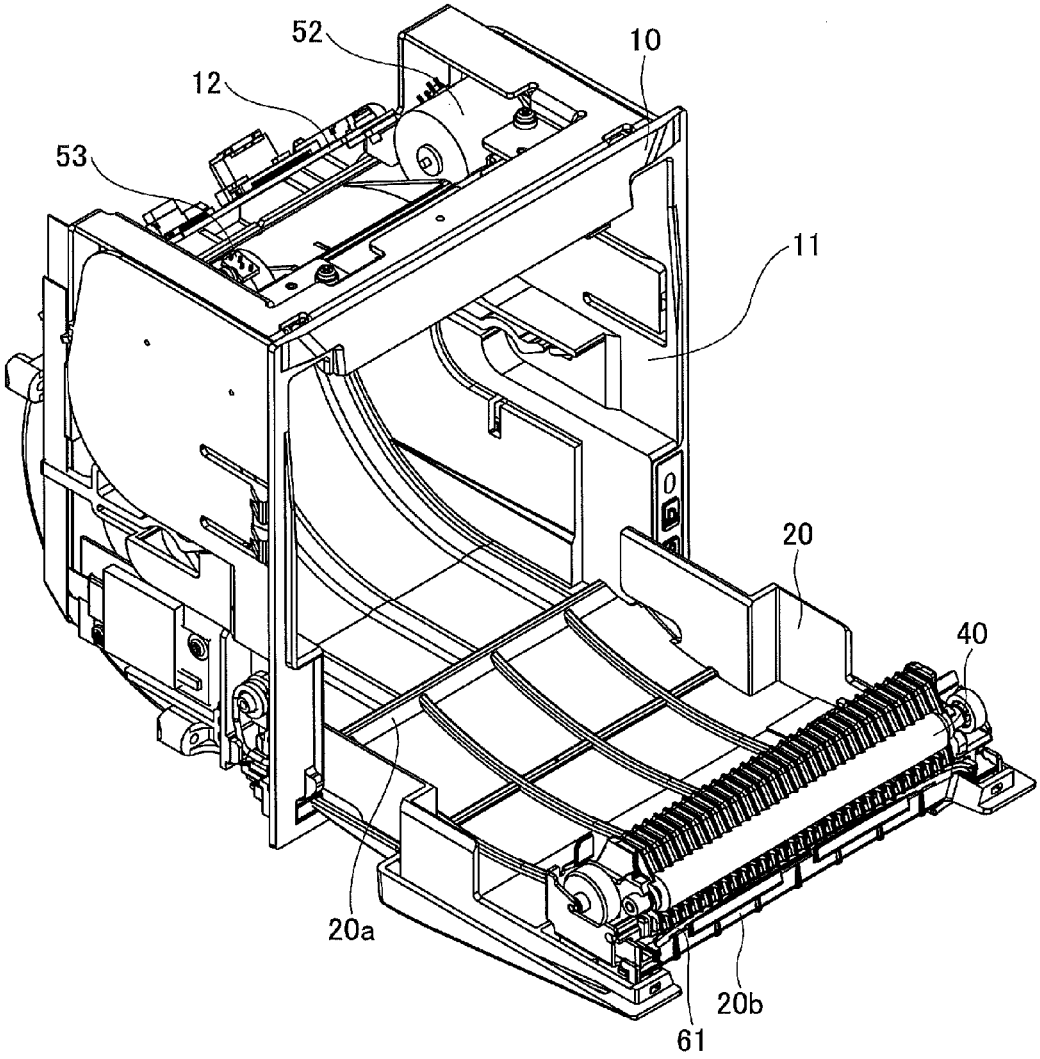
FIG. 3 is a perspective view of the printer with the lid opened according to the embodiment.
Figure 4:
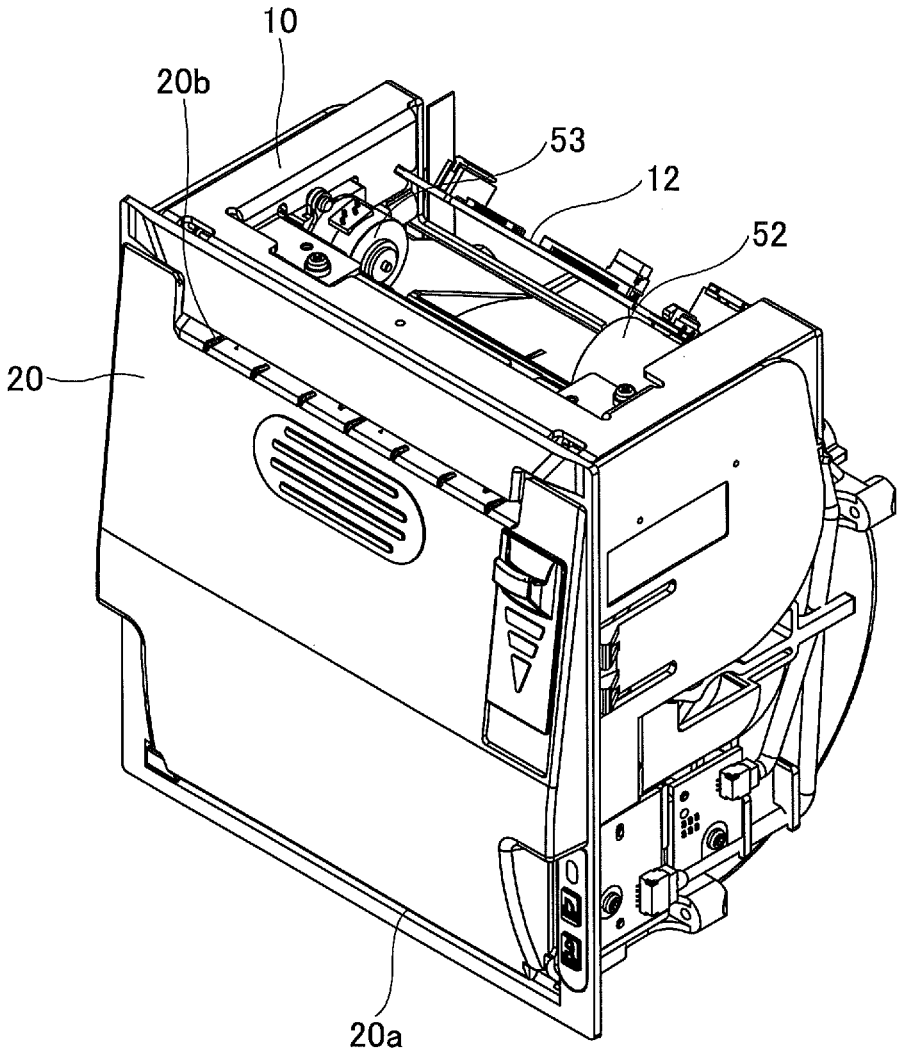
FIG. 4 is a perspective view of the printer with the lid closed according to the embodiment.

FIGS. 1 through 3 are perspective views of the printer with the lid opened, taken from different directions. FIG. 4 is a perspective view of the printer with the lid closed.

According to this embodiment, the printer is of a clamshell type, and includes a printer body 10 and a lid 20. The printer body 10 includes a recording paper holder 11 that defines a space for loading a roll of recording paper. A first end 20*a* of the lid 20 is connected to the printer body 10 in such a manner as to allow the lid 20 to be opened and closed relative to the printer body 10. That is, a rotation shaft 20*c* (illustrated in FIGS. 9 and 10) provided on part of the lid 20 near the first end 20*a* is connected to the printer body 10, and the lid 20 is opened and closed relative to the printer body 10 by rotating the lid 20 about the rotation shaft 20*c*.

According to this embodiment, at the time of using the printer, a roll of recording paper is placed inside the recording paper holder 11 of the printer body 10, and the lid 20 is closed as illustrated in FIG. 4. As a result, printing is ready to be performed on the recording paper in the printer.

The printer includes a thermal head 30 provided in the printer body 10. The thermal head 30 operates as a print head. The printer includes a platen roller 40 provided on the lid 20. The printer also includes a fixed blade 51 provided in the printer body 10 and a movable blade 61 provided on the lid 20. The printer further includes a conveyance motor 52 for rotating the platen roller 40 to convey the recording paper, and a movable blade motor 53 for driving the movable blade 61. The conveyance motor 52 and the movable blade motor 53 are provided in the printer body 10. The platen roller 40 and the movable blade 61 are provided near a second end 20*b* of the lid 20.

According to the printer, by closing the lid 20, the recording paper is held between the thermal head 30 and the platen roller 40, and is held between the fixed blade 51 and the movable blade 61. Thus, by closing the lid 20, the fixed blade 51 and the movable blade 61 are placed at predetermined positions to form a cutter, so that printing and cutting are ready to be performed on the recording paper. The printer further includes a control board 12 provided outside the printer body 10. The control board 12 is for controlling the printer.

Figure 5A:
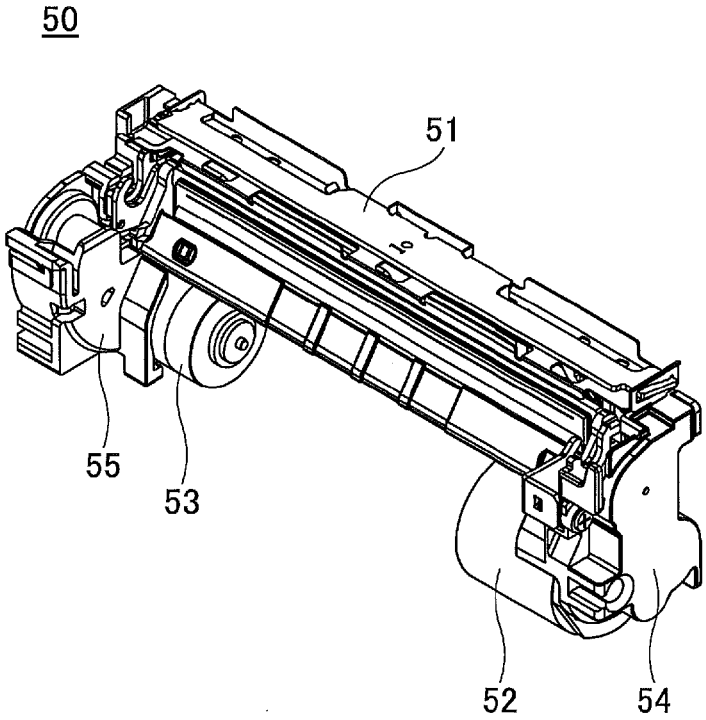
FIGS. 5A and 5B are diagrams illustrating a fixed blade unit of the printer according to the embodiment.
Figure 5B:
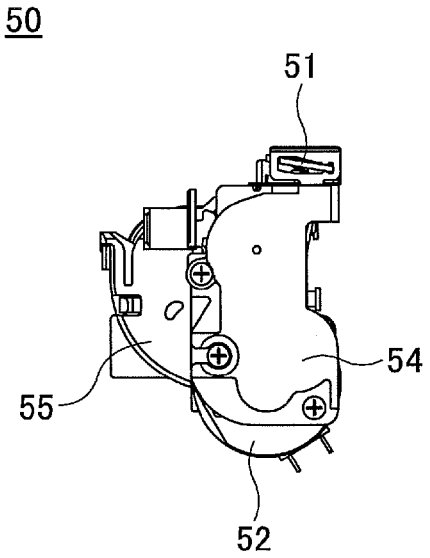

The printer includes a fixed blade unit 50 provided in the printer body 10. The fixed blade unit 50 includes the fixed blade 51. FIG. 5A is a perspective view of the fixed blade unit 50. FIG. 5B is a side view of the fixed blade unit 50. The fixed blade unit 50 includes the fixed blade 51, the conveyance motor 52, the movable blade motor 53, a conveyance gear box 54, and a movable blade gear box 55. The conveyance gear box 54 covers multiple conveyance gears provided inside the conveyance gear box 54. The movable blade gear box 55 covers multiple movable blade gears provided inside the movable blade gear box 55.

The platen roller 40 is rotated via the conveyance gears inside the conveyance gear box 54 by rotating the conveyance motor 52. The movable blade 61 is slid via the movable blade gears inside the movable blade gear box 55 by rotating the movable blade motor 53.

The conveyance gear box 54 and the movable blade gear box 55 are die castings made of zinc. The conveyance gear box 54 and the movable blade gear box 55 are positioned at a first longitudinal end and a second longitudinal end of the fixed blade unit 50, respectively.

Figure 6A:
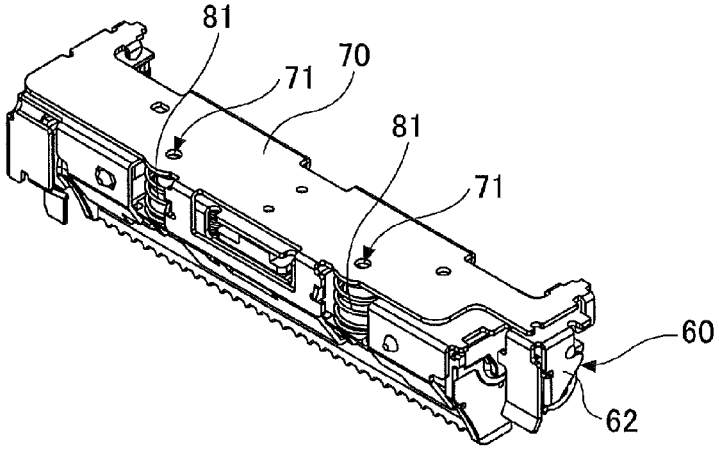
FIGS. 6A and 6B are diagrams illustrating a movable blade unit of the printer according to the embodiment.
Figure 6B:
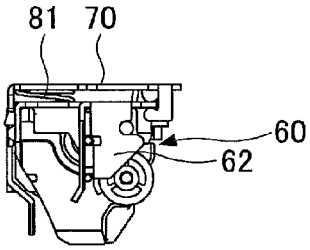
Figure 7:
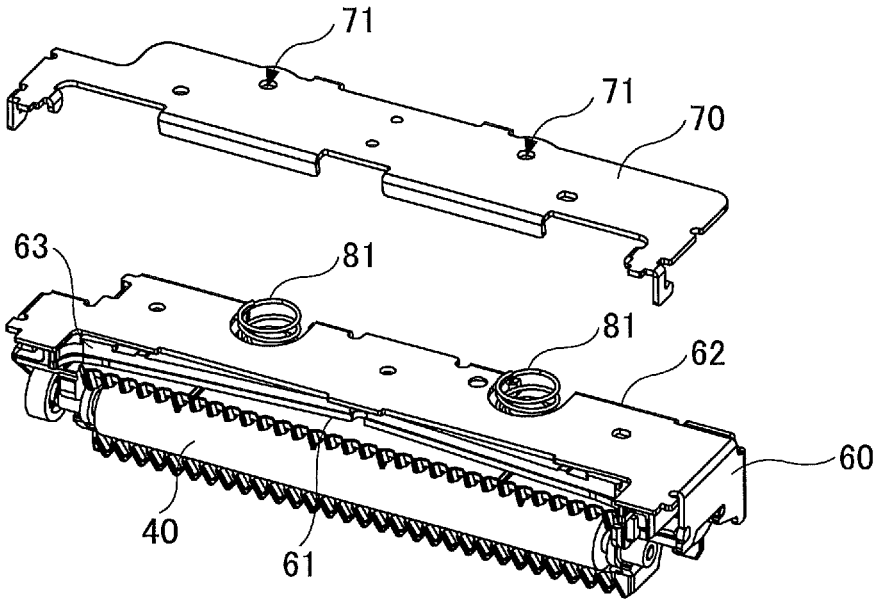
FIG. 7 is a diagram illustrating the movable blade unit of the printer according to the embodiment.

Furthermore, the printer includes a movable blade unit 60 as illustrated in FIGS. 6A, 6B and 7 provided near the second end 20*b* of the lid 20. The movable blade unit 60 includes the movable blade 61. FIG. 6A is a perspective view of the movable blade unit 60. FIG. 6B is a side view of the movable blade unit 60. FIG. 7 is a perspective view of the movable blade unit 60 with the platen roller 40 attached to and a gimbal plate 70 removed from the movable blade unit 60.

The movable blade unit 60 includes a movable blade unit housing 62. The movable blade unit housing 62 in its entirety is formed by bending a metal plate of stainless steel or the like. The movable blade 61 is provided inside the movable blade unit housing 62. The gimbal plate 70 is connected to the movable blade unit 60 on the side on which the movable blade unit 60 is attached to the lid 20. Two coil springs 81 are provided so as to intervene between the gimbal plate 70 and the movable blade unit 60. According to this embodiment, a screw is inserted through each of two attachment holes 71 formed in the gimbal plate 70, and the gimbal plate 70 is screwed to the lid 20 with the screws, so that the movable blade unit 60 is attached to the lid 20. Each attachment hole 71 is provided so as to align with the axial center of the corresponding coil spring 81.

The movable blade unit 60 is described in more detail with reference to FIG. 7. The gimbal plate 70 is formed by processing a metal plate of stainless steel or the like. The movable blade unit 60 includes a rack 63, and the movable blade 61 is attached to the rack 63. The movable blade 61 is slid together with the rack 63 via the movable blade gears in the movable blade gear box 55 by rotating the movable blade motor 53 in the fixed blade unit 50.

Figure 8A:
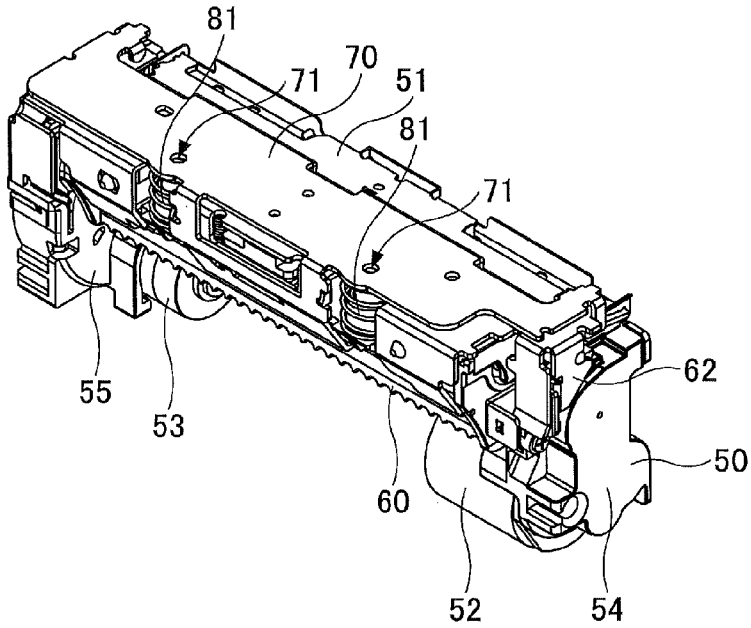
FIGS. 8A and 8B are diagrams illustrating the fixed blade unit and the movable blade unit of the printer in a connected state according to the embodiment.
Figure 8B:
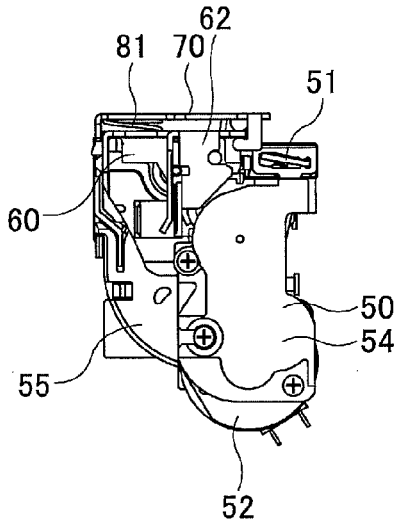

The fixed blade 51 and the movable blade 61 form a cutter. By closing the lid 20, the fixed blade unit 50 illustrated in FIGS. 5A and 5B and the movable blade unit 60 illustrated in FIGS. 6A and 6B are connected as illustrated in FIGS. 8A and 8B. FIGS. 8A and 8B are a perspective view and a side view, respectively, of the fixed blade unit 50 and the movable blade unit 60 with the lid 20 closed in the printer.

Figure 9:
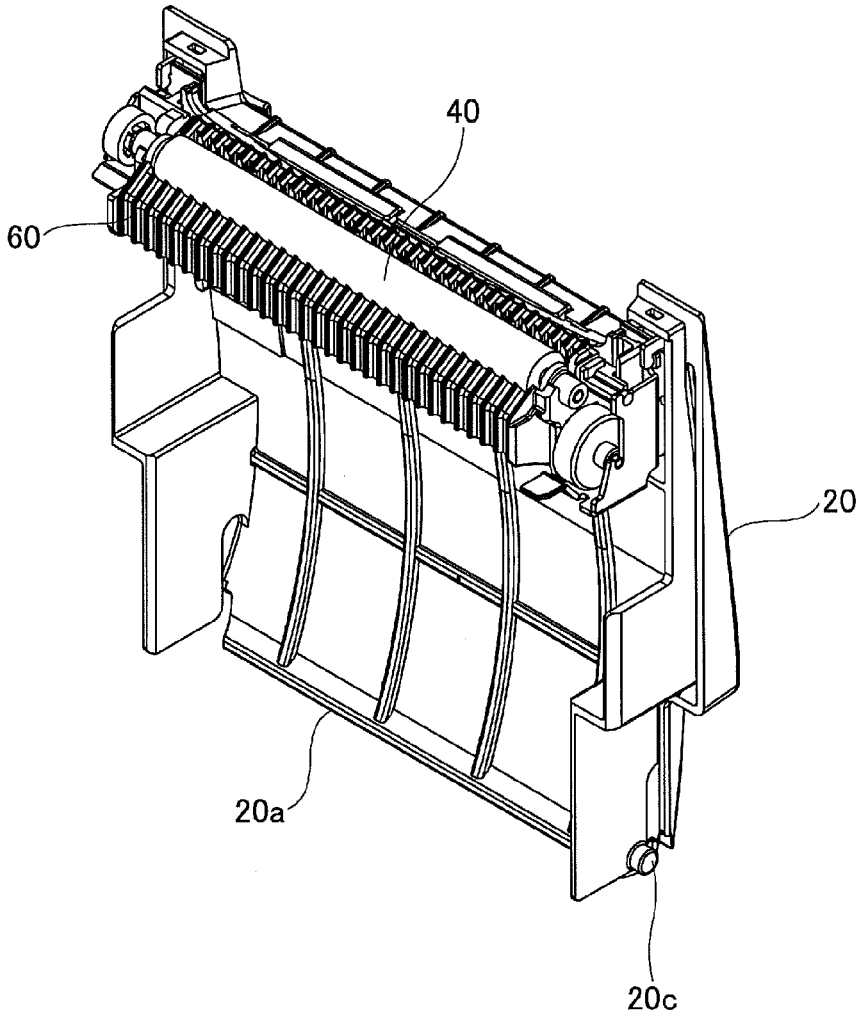
FIG. 9 is a perspective view of the lid on which the movable blade unit is provided.
Figure 10:
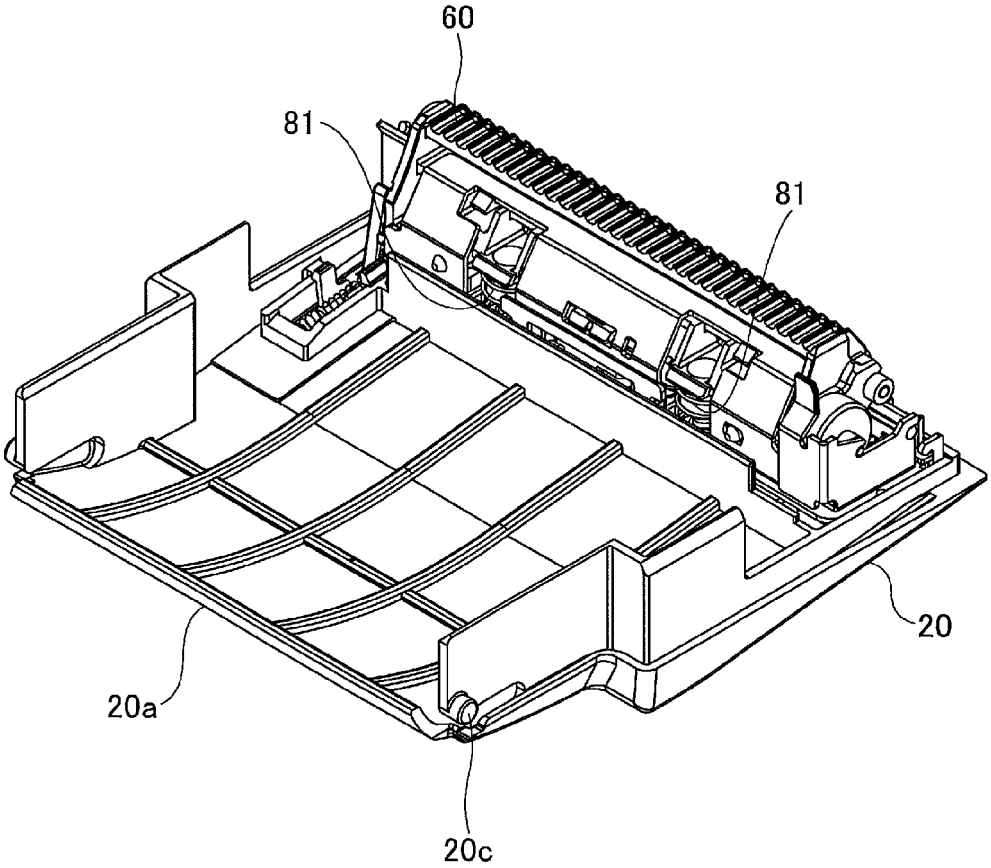
FIG. 10 is a perspective view of the lid on which the movable blade unit is provided.
Figure 11:
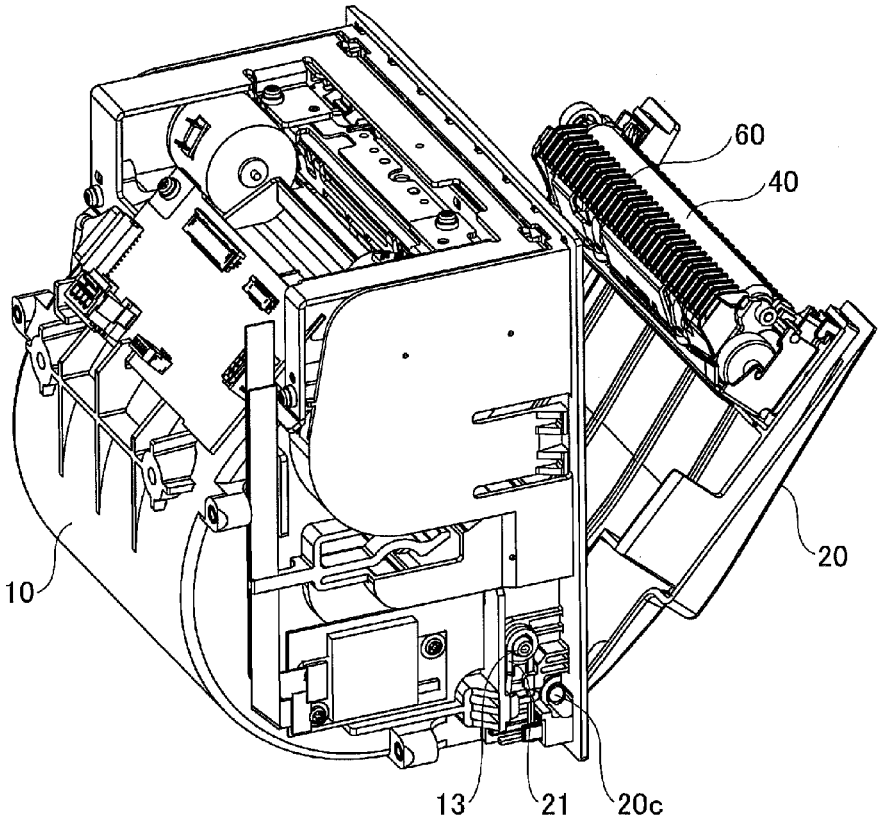
FIG. 11 is a diagram illustrating the printer in which a damper spring is provided.
Figure 12:
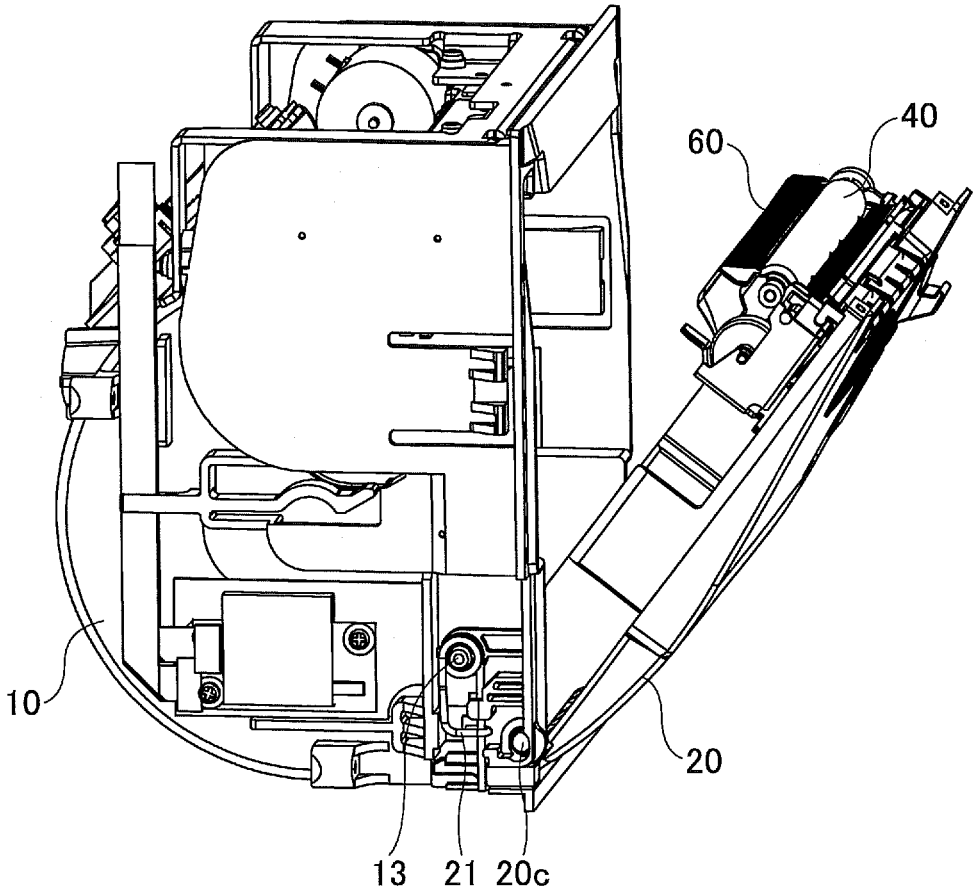
FIG. 12 is a diagram illustrating the printer in which the damper spring is provided.

Next, the lid 20 is described with reference to FIGS. 9 through 13. FIGS. 9 and 10 are perspective views of the removed lid 20, taken from different directions. As illustrated in FIGS. 9 and 10, the rotation shaft 20*c* is provided on part of the lid 20 near the first end 20*a*. As illustrated in FIGS. 11 and 12, the lid 20 is rotatably connected to the printer body 10 via the rotation shaft 20*c*. The lid 20 is partly or entirely formed of a material that contains a resin material such as polycarbonate (PC) or acrylonitrile butadiene styrene (ABS). The printer body 10 as well is partly or entirely formed of a resin material.

Figure 13:
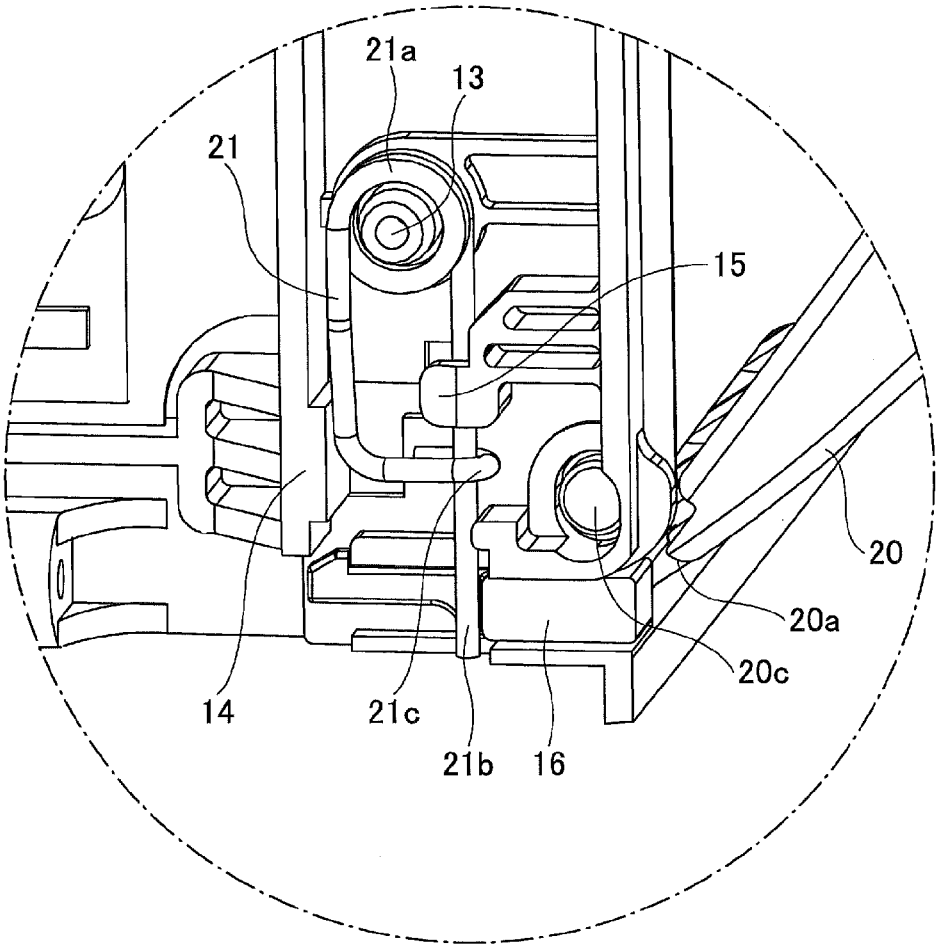
FIG. 13 is a diagram illustrating the damper spring.

According to the printer, a damper spring 21 is provided on the printer body 10 in order to absorb impact caused by the lid 20 when the lid 20 opens with force. As illustrated in FIG. 13, the damper spring 21 is a kind of torsion coil spring, and includes a coil spring part 21*a*, a linear part 21*b*, and a hook part 21*c*. The linear part 21*b* extends linearly from a first end of the coil spring part 21*a* to terminate at a first end of the damper spring 21. The hook part 21*c* extends from a second end of the coil spring part 21*a* to terminate at a second end of the damper spring 21. FIG. 13 is an enlarged view of part of FIG. 12, illustrating a state of the printer where no force is applied to the damper spring 21. The hook part 21*c* has a U-letter shape. The linear part 21*b* passes through a space formed inside a U-shaped portion of the hook part 21*c*. In this state, the restoring force of the damper spring 21 works in a direction to move the first end and the second end of the damper spring 21 away from each other. The damper spring 21, however, is prevented from opening up because the linear part 21*b* is held by the hook part 21*c*.

The damper spring 21 is provided on the printer body 10 with a coiled portion of the damper spring 21 fitted around a damper spring placement part 13 of the printer body 10. The second end of the coil spring part 21*a* is in contact with a first projection 14 of the printer body 10. Furthermore, the linear part 21*b* of the damper spring 21 is in contact with a second projection 15 and a slidable part 16 of the printer body 10. The slidable part 16 slides with the opening and closing of the lid 20.

Figure 14:
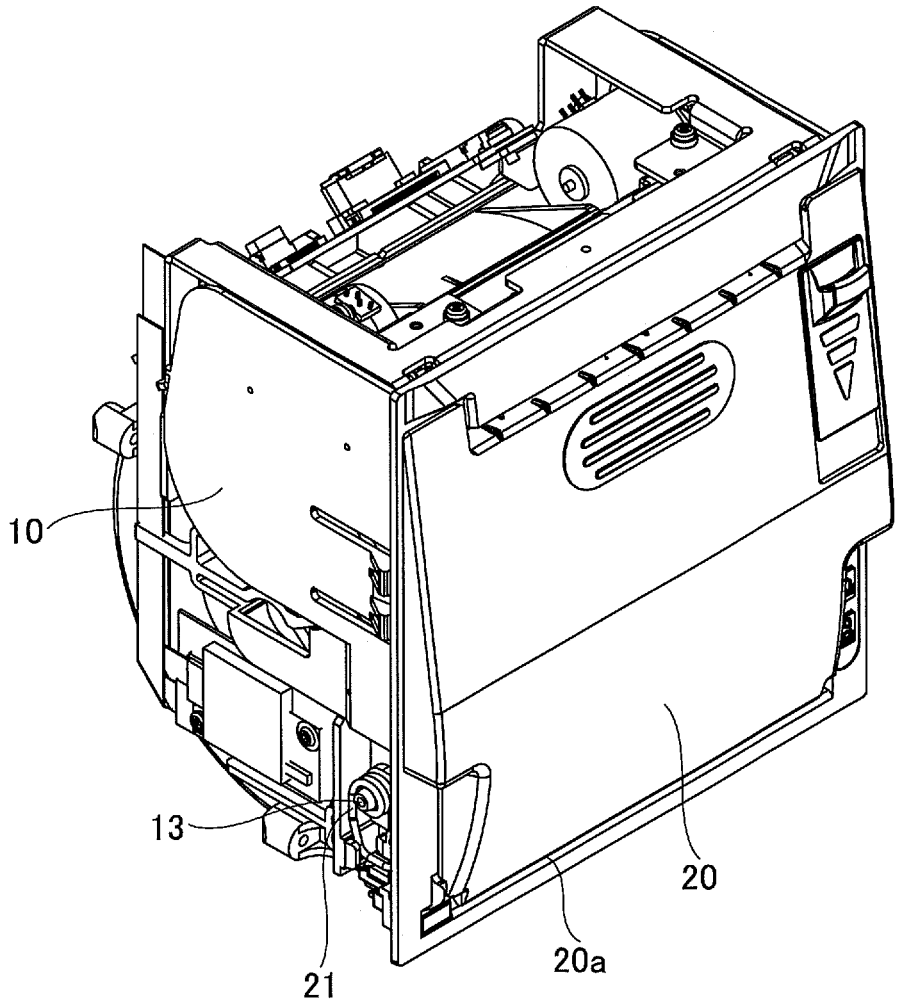
FIG. 14 is a diagram illustrating the printer in which the damper spring is provided.

Next, the case of opening the lid 20 in the printer is described. Like in the state illustrated in FIG. 13, no force is applied to the damper spring 21 when the lid 20 is closed as illustrated in FIG. 14. Accordingly, the lid 20 in the closed state is freely openable with no restoring force of the damper spring 21 applied to the lid 20. By opening the lid 20 in the closed state, the lid 20 is partially opened as illustrated in FIG. 12. In the state illustrated in FIG. 12 as well, no force is applied to the damper spring 21, so that the lid 20 is freely openable.

Figure 15:
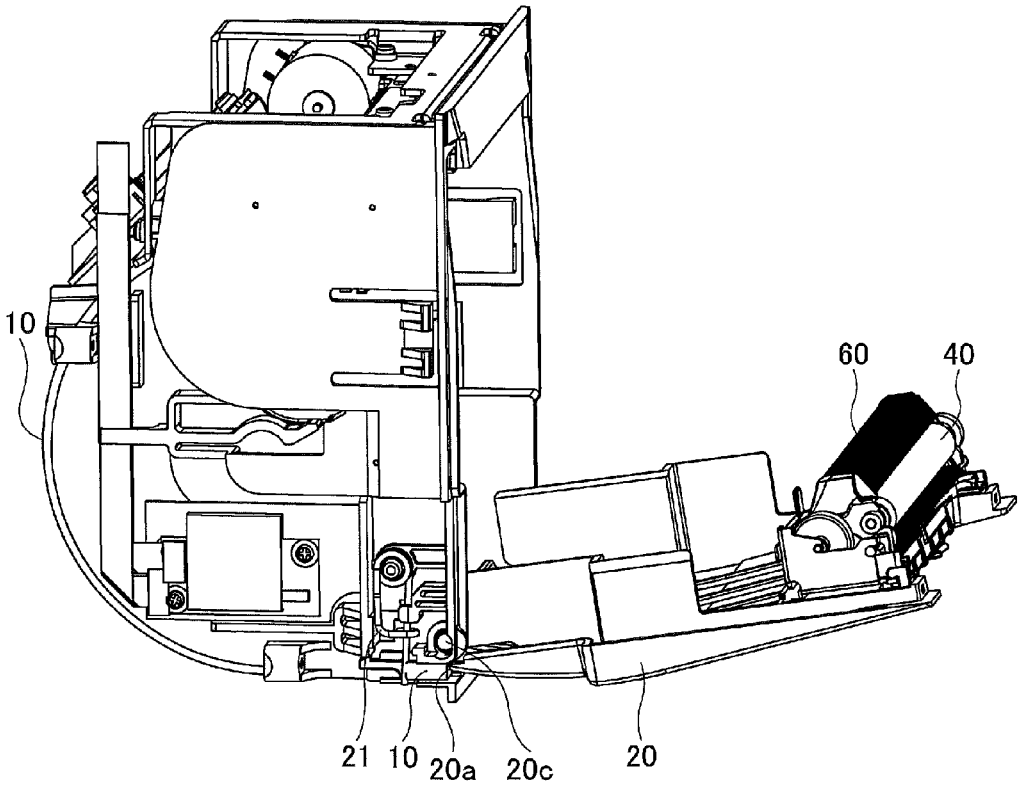
FIG. 15 is a diagram illustrating the printer in which the damper spring is provided.
Figure 16:
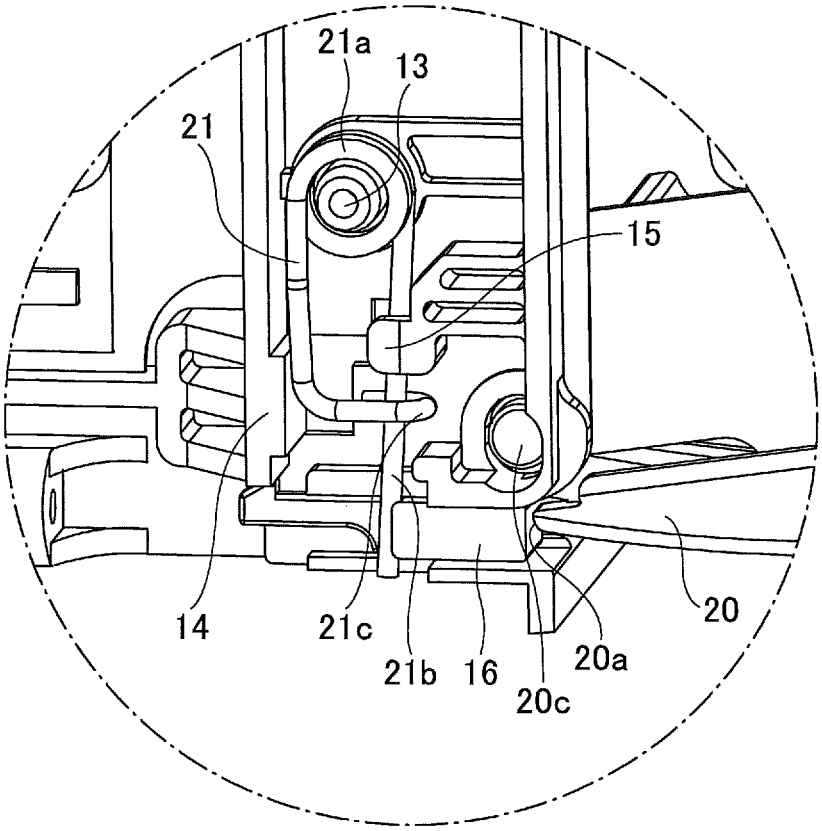
FIG. 16 is a diagram illustrating the damper spring.

Thereafter, by further opening the lid 20, the lid 20 is fully opened as illustrated in FIGS. 15 and 16. FIG. 16 is an enlarged view of part of FIG. 15. In the state illustrated in FIGS. 15 and 16, the lid 20 rotates on the rotation shaft 20*c*, so that the slidable part 16 of the printer body 10 is pressed by the first end 20*a* of the lid 20 so as to slide inward in the printer body 10. As the slidable part 16 slides inward in the printer body 10, the linear part 21*b* of the damper spring 21 is pressed by the slidable part 16. As a result, the restoring force of the damper spring 21 that has pressed the hook part 21*c* is applied to the slidable part 16. Accordingly, a force is exerted on the slidable part 16 in a direction to push back the slidable part 16, so that the restoring force of the damper spring 21 is applied to the lid 20. Therefore, even when the lid 20 is opened violently, the impact of the violent opening is absorbed by the damper spring 21, so that it is possible to reduce the impact.

Next, the case of using the printer of this embodiment as an independent printer is described with reference to FIGS. 17 through 21. In this case, the printer as illustrated in FIGS. 1 through 4 is covered with a metal housing.

Figure 17:
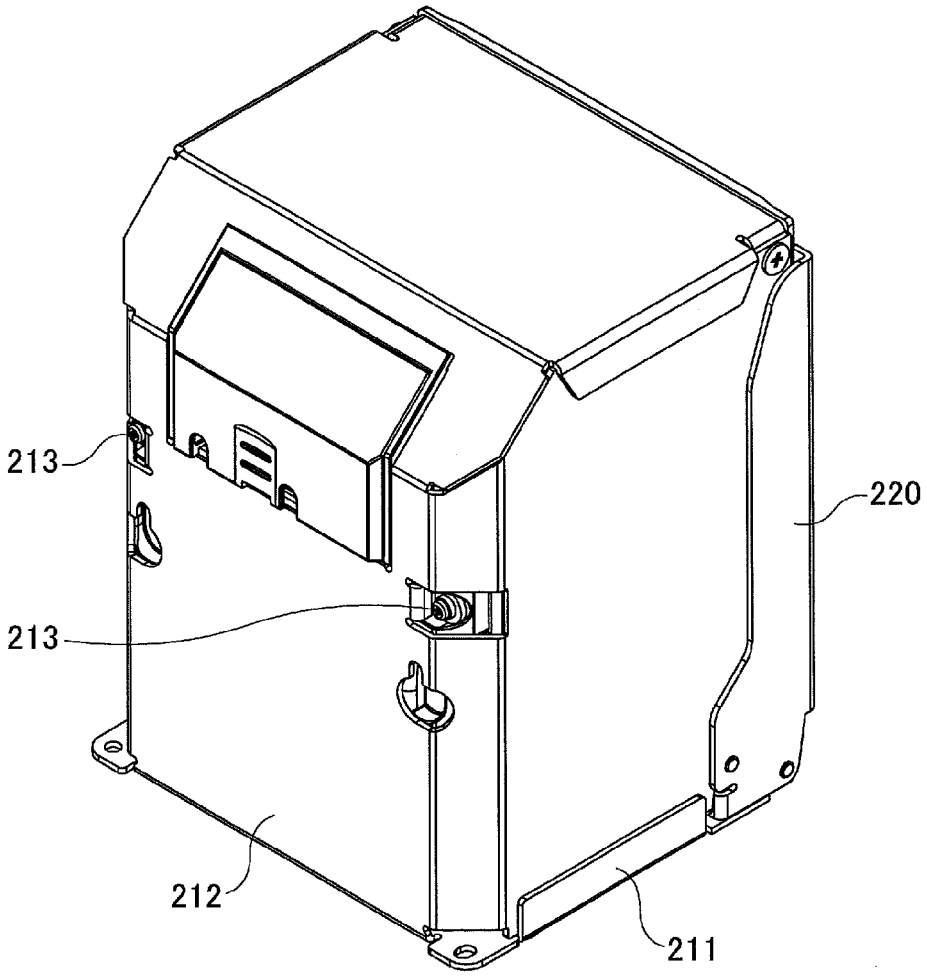
FIG. 17 is a perspective view of the printer in which a metal lid is provided according to the embodiment.
Figure 18:
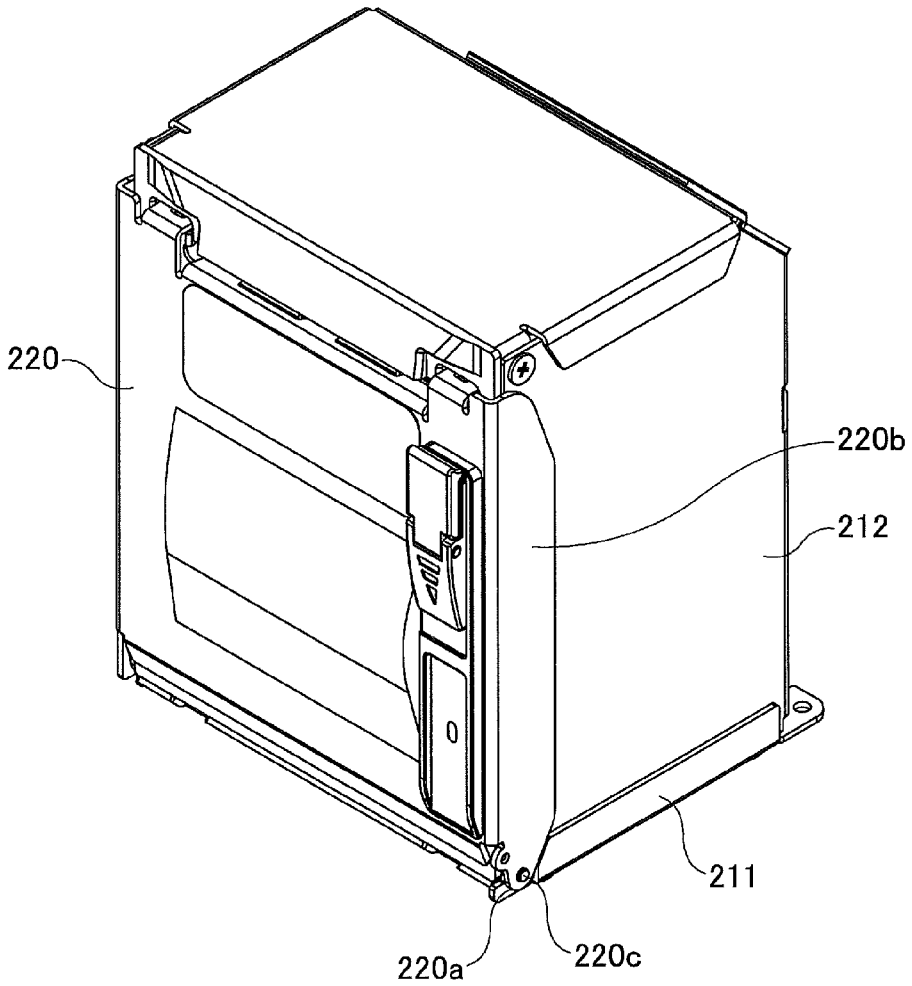
FIG. 18 is a perspective view of the printer in which the metal lid is provided according to the embodiment.
Figure 19:
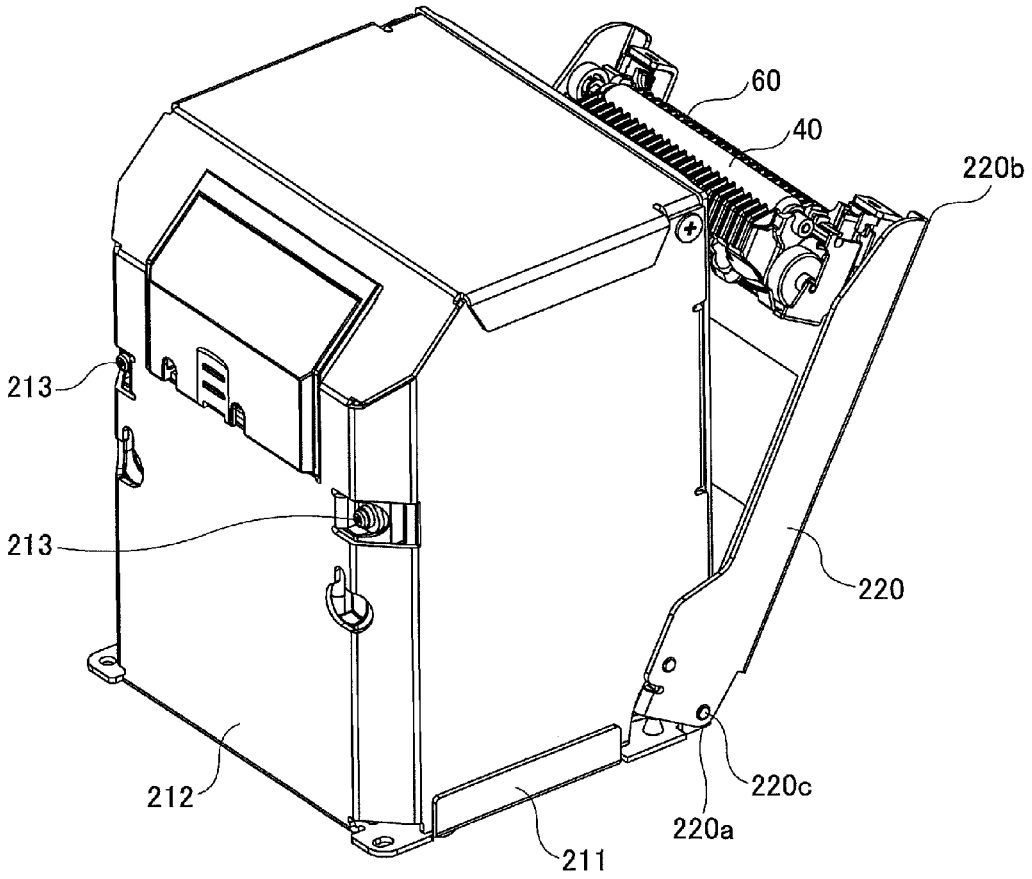
FIG. 19 is a perspective view of the printer in which the metal lid is provided according to the embodiment.
Figure 20:
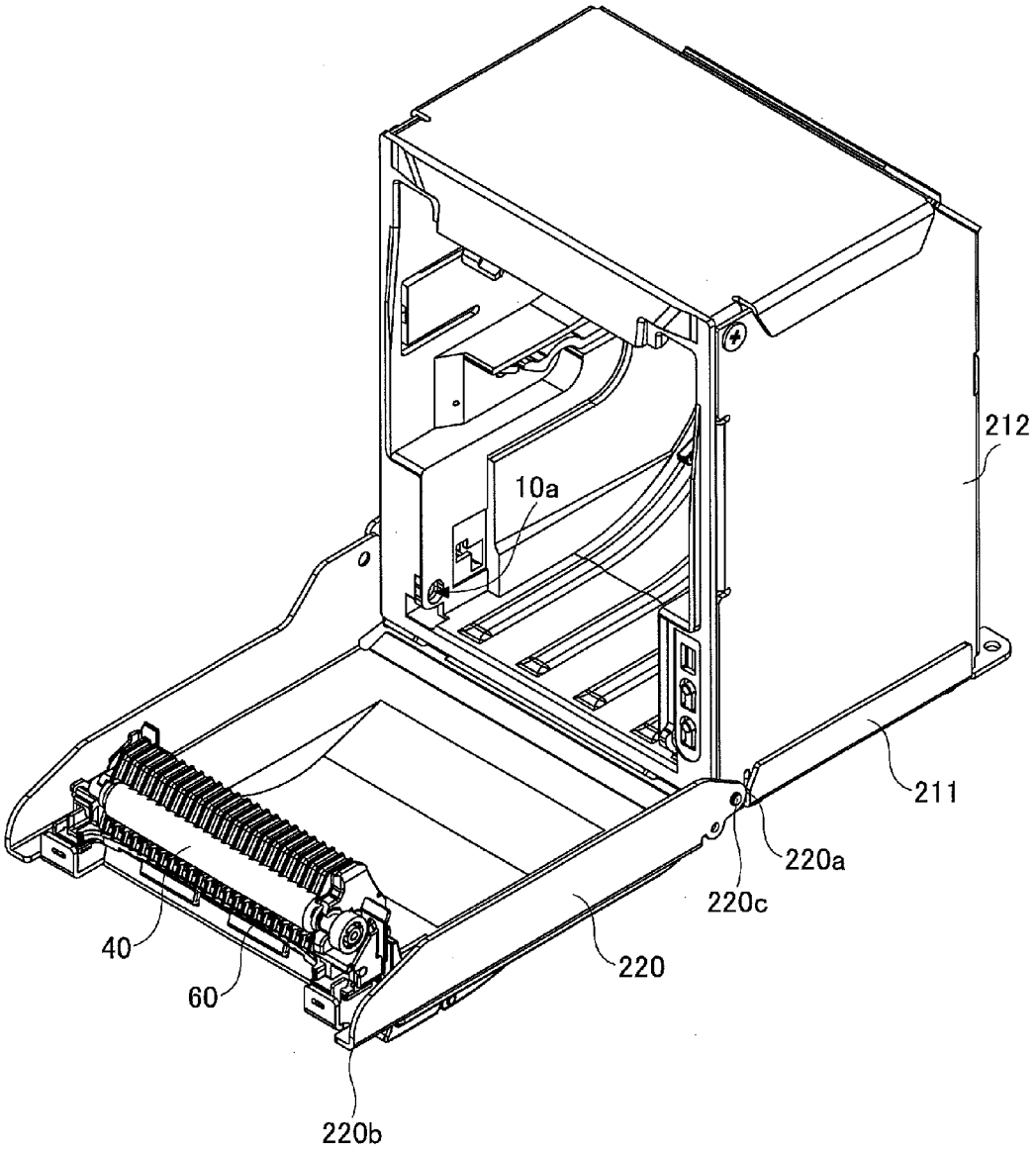
FIG. 20 is a perspective view of the printer in which the metal lid is provided according to the embodiment.

Referring to FIGS. 17 through 20, a bottom cover 211 is attached to the bottom and a rear cover 212 is attached to sides and the top of the printer illustrated in FIGS. 1 through 4. Furthermore, the lid 20 is replaced with a metal lid 220. The bottom cover 211, the rear cover 212, and the metal lid 220 form the metal housing of the printer. FIGS. 17 and 18 are perspective views of the printer with the metal lid 220 closed, taken from different directions. FIG. 19 is a perspective view of the printer with the metal lid 220 partially opened. FIG. 20 is a perspective view of the printer with the metal lid 220 fully opened. In FIG. 20, reference numeral 10*a* denotes an opening provided in the printer body 10 for inserting the rotation shaft 20*c* of the removed lid 20.

Each of the bottom cover 211, the rear cover 212, and the metal lid 220 is formed by processing a metal plate. The rear cover 212 may be attached to the printer body 10 by being fastened to the recording paper holder 11 of the printer body 10 with screws 213 or the like as illustrated in FIGS. 17 and 19. The metal lid 220 is attached to the rear cover 212 after detaching the lid 20 illustrated in FIGS. 9 and 10 from the printer body 10. For example, a first end 220*a* of the metal lid 220 is connected to the rear cover 212 so that the metal lid 220 is rotatable on a rotation shaft 220*c*. The movable blade unit 60 and the platen roller 40 are provided on part of the metal lid 220 near a second end 220*b* of the metal lid 220. The positions at which the movable blade unit 60 and the platen roller 40 are provided on the metal lid 220 are the same as those on the lid 20.

The metal lid 220 is formed of a metal material. Therefore, if the metal lid 220 were directly connected to the printer body 10 formed of a resin material, part of the printer body 10 connected to the metal lid 220 could be broken by the metal lid 220. According to this embodiment, however, the metal lid 220 is connected to the rear cover 212 also formed of a metal material so as to be rotatable on the rotating shaft 220*c*. Accordingly, no breakage occurs in the connection of the metal lid 220 at the rotation shaft 220*c*.

Figure 21:
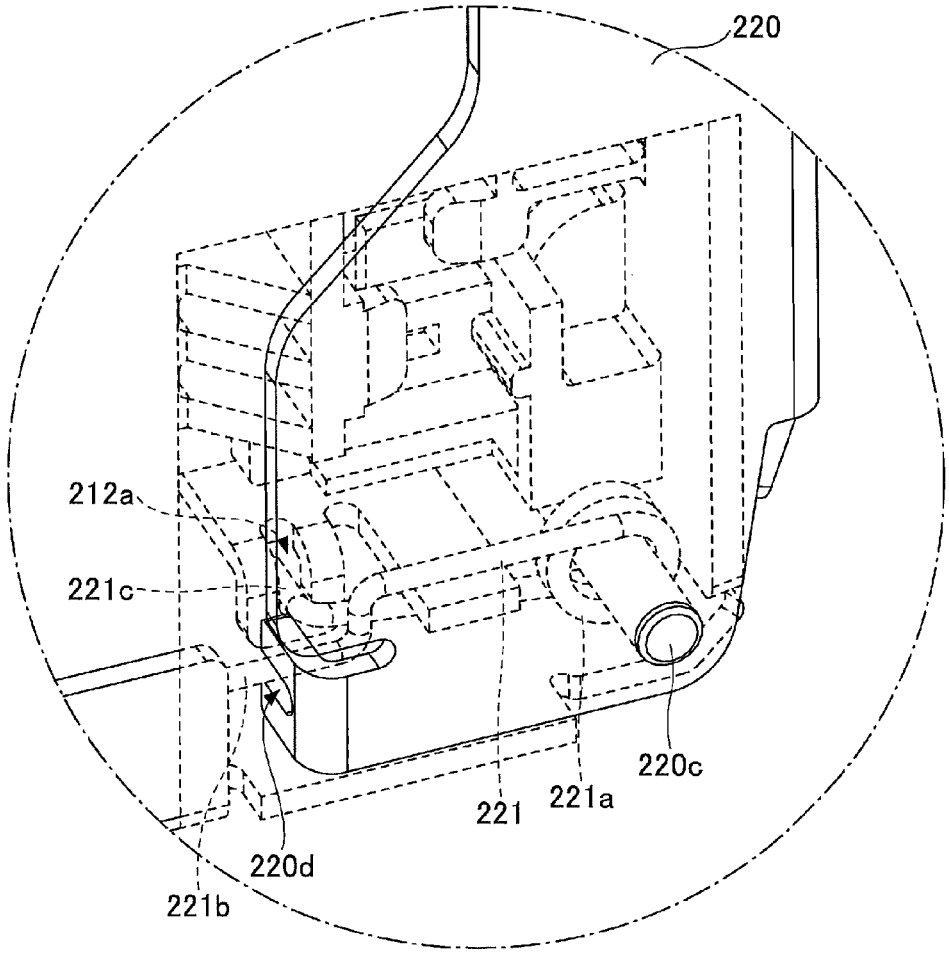
FIG. 21 is a diagram illustrating a metal lid damper spring.

Next, a metal lid damper spring provided in the printer when the metal housing is attached to the printer is described. When the lid 20 is replaced with the metal lid 220, a metal lid damper spring 221 that acts on the metal lid 220 as illustrated in FIG. 21 is provided in the printer. FIG. 21 is an enlarged view of part of the interior of the printer as illustrated in FIG. 17, illustrating the metal lid damper spring 221 with the metal lid 220 closed.

The metal lid damper spring 221 is a torsion coil spring, and includes a coil spring part 221*a*, a first connecting part 221*b* formed next to a first end of the coil spring part 221*a*, and a second connecting part 221*c* formed next to a second end of the coil spring part 221*a*. Each of the first connecting part 221*b* and the second connecting part 221*c* may include a bent portion. The first connecting part 221*b* is placed inside and fixed to a first hook part 220*d* of the metal lid 220. The second connecting part 221*c* is placed inside and fixed to a second hook part 212*a* of the rear cover 212.

Figure 22:
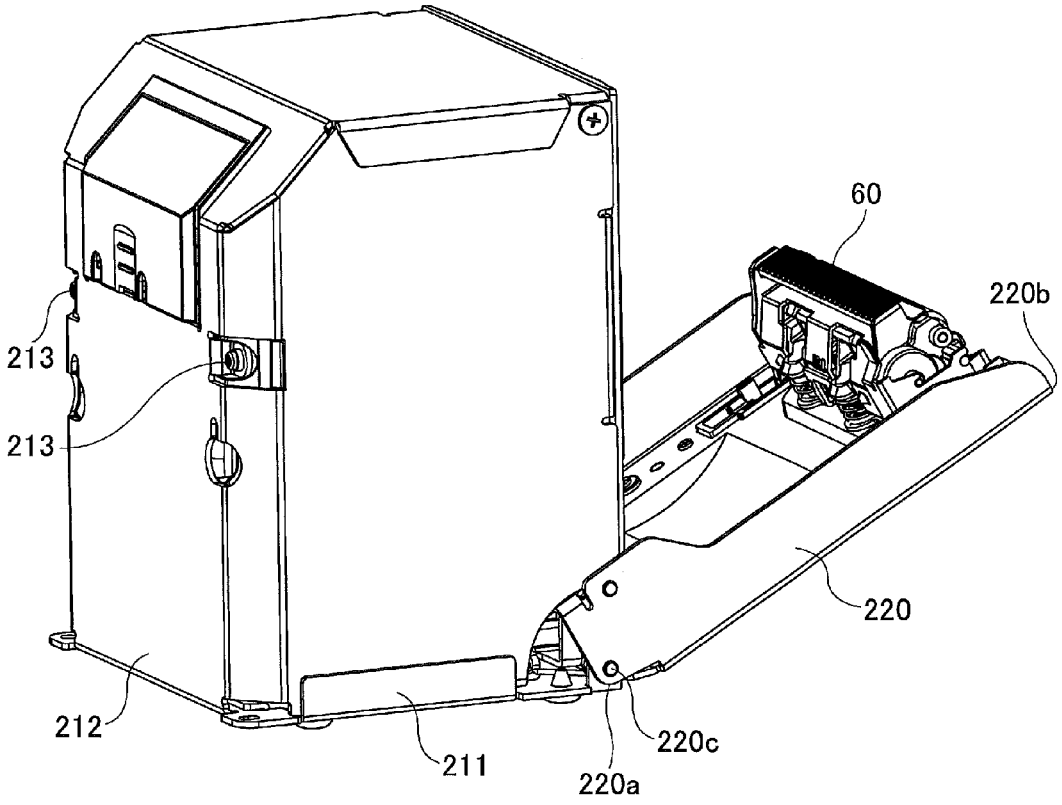
FIG. 22 is a perspective view of the printer in which the metal lid is provided according to the embodiment.
Figure 23:
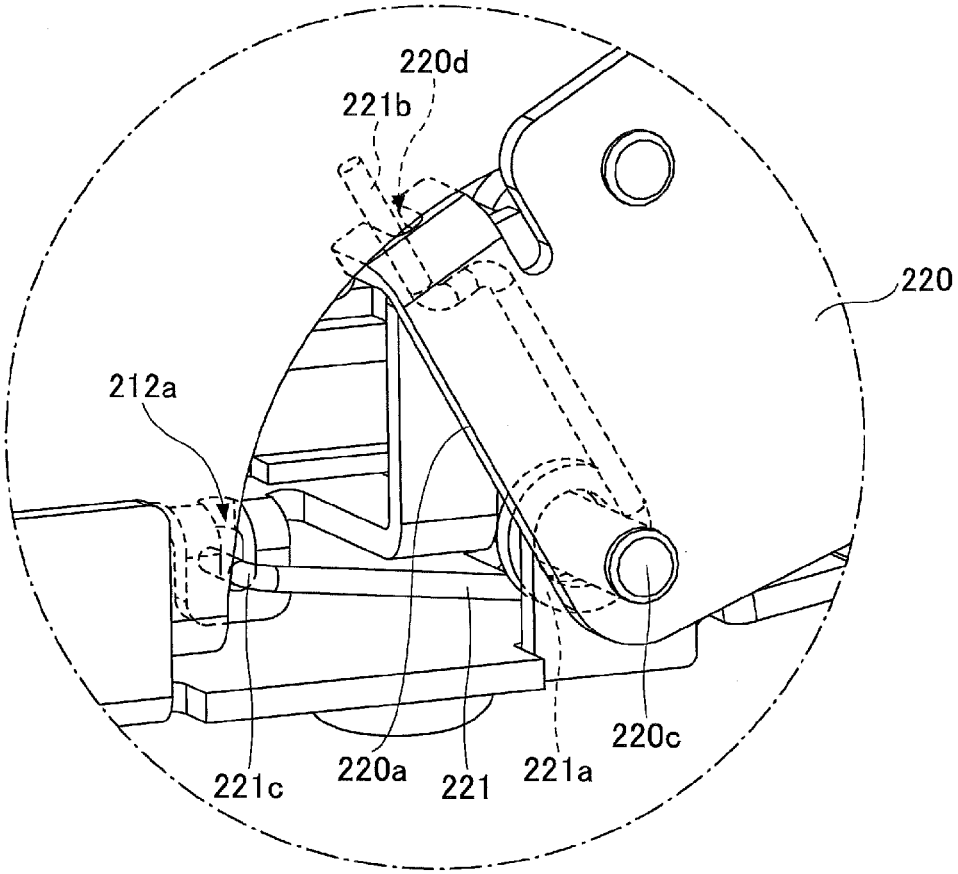
FIG. 23 is a diagram illustrating the metal lid damper spring.

The metal lid damper spring 221 exerts no restoring force when the metal lid 220 is closed as illustrated in FIGS. 17 and 21. The restoring force of the metal lid damper spring 221 gradually increases as the metal lid 220 is opened as illustrated in FIG. 19. The restoring force further increases as the metal lid 220 is further opened as illustrated in FIGS. 22 and 23. Thus, even when the metal lid 220 is opened with force, it is possible to absorb the impact of the opening with the metal lid damper spring 221. FIG. 23 is an enlarged view of part of FIG. 22.

As an alternative, the bottom cover 211 may be attached to the bottom and the rear cover 212 may be attached to sides and the top of the printer illustrated in FIGS. 1 through 4 while retaining the lid 20.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printer, comprising:

a printer body including a print head;

a lid connected to the printer body so as to be opened and closed relative to the printer body;

a damper spring provided on the printer body, the damper spring includes a coil spring;

a first end extending from a first end of the coil spring; and a second end extending from a second end of the coil spring and engaging with the first end of the damper spring, wherein the damper spring exerts a restoring force in a direction to move the first end of the damper spring and the second end of the damper spring away from each other; and a slidable part provided in the printer body, wherein when the lid is opened, the slidable part is pressed by the lid so as to press the first end of the damper spring so that the damper spring exerts the restoring force in a direction to close the lid.

2. The printer as claimed in claim 1, wherein the first end of the damper spring has a linear shape and the second end of the damper spring includes a hook, and the hook engages with the first end of the damper spring.

3. The printer as claimed in claim 1, further comprising:

a fixed blade unit provided in the printer body, the fixed blade unit including a fixed blade, a conveyance motor, a movable blade motor, a conveyance gear box, and a movable blade gear box;

a platen roller provided on the movable blade unit; and a movable blade unit provided on the lid, the movable blade unit including a movable blade, wherein the platen roller is rotated by the conveyance motor via gears in the conveyance gear box, and the movable blade is driven by the movable blade motor via gears in the movable blade gear box.

4. A printer, comprising:

a printer body including a print head;

a metal cover attached to the printer body so as to cover the printer body except for one side of the printer body;

a lid connected to the printer body or the metal cover so as to be opened and closed relative to the one side of the printer body;

a cutter including a fixed blade and a movable blade that cuts recording paper;

a fixed blade unit provided in the printer body, the fixed blade unit including the fixed blade; and a movable blade unit provided on the lid, the movable blade unit including the movable blade.

5. The printer as claimed in claim 4, further comprising:

a damper spring provided on the lid, wherein when the lid is opened, the damper spring is pressed by the lid so as to exert a restoring force in a direction to close the lid.

6. The printer as claimed in claim 4, wherein the fixed blade unit further includes a conveyance motor, a movable blade motor, a conveyance gear box, and a movable blade gear box, a platen roller is provided on the movable blade unit, the platen roller is rotated by the conveyance motor via gears in the conveyance gear box, and the movable blade is driven by the movable blade motor via gears in the movable blade gear box.

7. A housing, comprising:

a main body;

a lid connected to the main body so as to be opened and closed relative to the main body;

a slidable part that is provided in the main body and slides when pressed by the lid while the lid is opened; and a damper spring that is provided in the main body and includes a first portion that comes in contact with the slidable part, wherein, when the slidable part slides while the lid is opened, the first portion is pressed by the slidable part and the damper spring exerts, a restoring force so as to push back the slidable part in a direction to close the lid.

8. The housing as claimed in claim 7, wherein the damper spring further includes a second portion that is formed in a hook shape and engages with the first portion so as to prevent the first portion from opening.

9. The housing as claimed in claim 7, wherein the damper spring is a coil spring.

* * * * *